US006054911A

United States Patent [19]

Herbst et al.

[11] Patent Number: 6,054,911

[45] Date of Patent: Apr. 25, 2000

[54] ELECTRICAL SWITCHING DEVICE

[75] Inventors: Reinhard Herbst, Wernberg-Köblitz; Bardo Koppmann, Kaltenbrunn, both of Germany

[73] Assignee: Siemens Aktiengesellschaft, Munich, Germany

[21] Appl. No.: 09/101,909

[22] PCT Filed: Jan. 16, 1997

[86] PCT No.: PCT/EP97/00182

§ 371 Date: Jul. 20, 1998

§ 102(e) Date: Jul. 20, 1998

[87] PCT Pub. No.: WO97/27605

PCT Pub. Date: Jul. 31, 1997

[30] Foreign Application Priority Data

Jan. 22, 1996 [DE] Germany ..... 196 02 118
Jul. 26, 1996 [EP] European Pat. Off. ..... 96112126

[51] Int. Cl.[7] ..... H01H 67/02

[52] U.S. Cl. ..... 335/132; 218/34; 218/156

[58] Field of Search ..... 335/6, 16, 147, 335/195, 132, 202; 218/22, 23, 28, 29, 30, 31, 34, 36, 56

[56] References Cited

U.S. PATENT DOCUMENTS

| | | | |
|---|---|---|---|
| 4,112,275 | 9/1978 | Kohler | 218/22 |
| 4,132,968 | 1/1979 | Lang | 335/16 |
| 4,195,212 | 3/1980 | Graham et al. . | |
| 4,292,611 | 9/1981 | Bresson et al. | 335/6 |
| 4,378,542 | 3/1983 | Feil | 335/132 |
| 4,408,173 | 10/1983 | Adlerteg et al. | 335/16 |
| 5,163,175 | 11/1992 | Mori et al. | 335/132 |

FOREIGN PATENT DOCUMENTS

| | | |
|---|---|---|
| 0 351 724 | 1/1990 | European Pat. Off. . |
| 41 04 533 | 8/1991 | Germany . |

*Primary Examiner*—Lincoln Donovan
*Attorney, Agent, or Firm*—Kenyon & Kenyon

[57] ABSTRACT

A switching device in which destructive stress on the contact carrier when short-circuit forces occur when ON is prevented. Stops on the arcing chamber limit the opening movement of the contact bridge before the contact spring is compressed to its block dimension.

2 Claims, 1 Drawing Sheet

ELECTRICAL SWITCHING DEVICE

FIELD OF THE INVENTION

The present invention relates to an electric switching device with an electromagnetic system, an arcing chamber, fixed contacts, a contact bridge with movable contacts, a contact carrier with a window in which the contact bridge is held by a contact spring with assembly dimension C, wherein the fixed contacts are a distance Ö from the movable contacts when the electromagnetic system is OFF, and wherein the contact spring experiences a spring action D when the electromagnetic system is ON, so that the contact carrier covers distance D+Ö between ON and OFF and back.

BACKGROUND INFORMATION

A conventional switching device is described in German Patent No. 41 04 533 2. If a short-circuit occurs when this switching device is ON, short-circuit electrodynamic forces act on the contact bridge, moving the contact bridge into open position. The contact spring is thus compressed to block dimension, and the contact carrier is moved upward. The resulting forces may have a destructive effect on the contact carrier.

SUMMARY OF THE INVENTION

An object of the present invention is to create an electric switching device in which destructive stresses on the contact carrier due to short-circuit electrodynamic forces are avoided.

This object is achieved by providing stops on the arcing chamber on the side facing away from the fixed contacts on the contact bridge at a distance A from the contact bridge when OFF, so that in the event of a short circuit, the stops limit the opening movement of the contact bridge due to the short-circuit electrodynamic forces when the electromagnetic system is on, so that the contact spring is not compressed to its block dimension B.

Another advantageous embodiment is obtained when the following condition is met:

$$C-(D+\ddot{O}+A)>B$$

DETAILED DESCRIPTION

Figures 1, 2, 3:
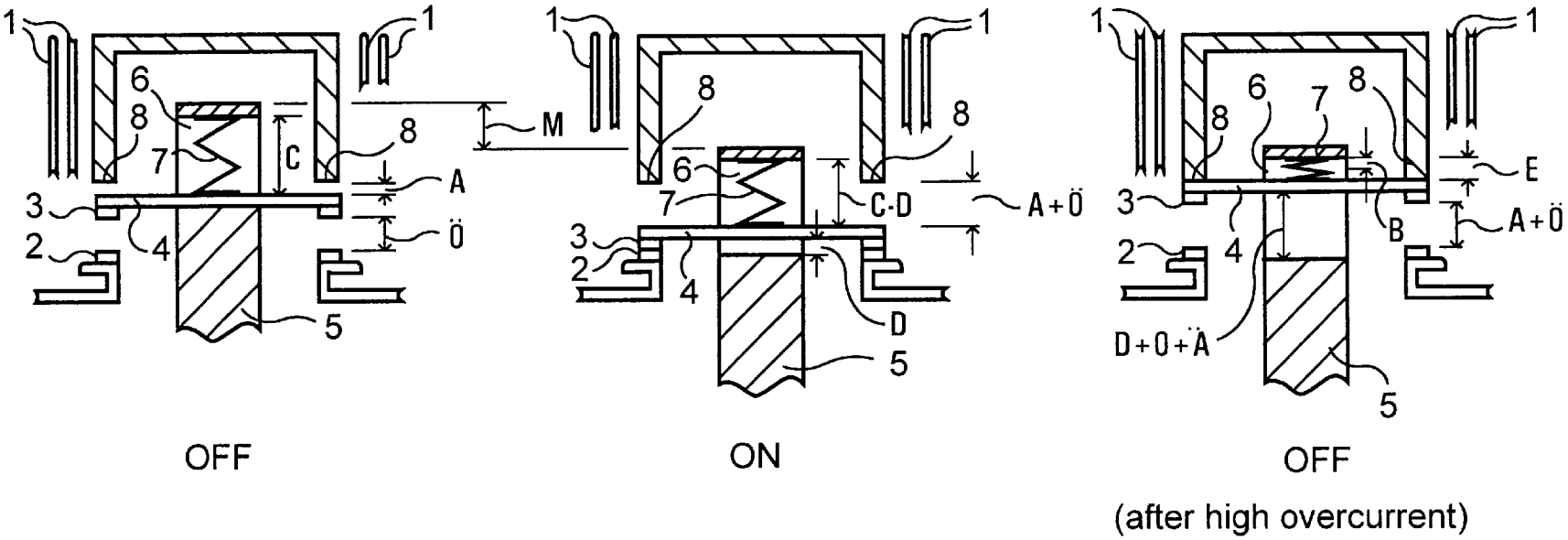
FIG. 1 illustrates a contact system of an electromagnetic switching device in an OFF state, in accordance with an exemplary embodiment of the present invention.
FIG. 2 illustrates the contact system of FIG. 1 in an ON state.
FIG. 3 illustrates the contact system of FIG. 2 after a short-circuit occurs when the contact system is in an ON state.

FIG. 1 shows a contact system of an electromagnetic switching device. The contact system is positioned in an arcing chamber with arc splitters 1 and includes fixed contacts 2, movable contacts 3 on a contact bridge 4, a contact carrier 5 with a window 6, and a contact spring 7. In the present OFF state of the electromagnetic system, contact spring 7 presses contact bridge 4 to the lower edge of window 6 and has assembly length C. Movable contacts 3 are positioned at a distance Ö from fixed contacts 2. Stops 8 provided adjacent to the side of contact bridge 4 facing away from fixed contacts 2 a distance A away from them are fixedly connected to the arcing chamber in an advantageous manner, e.g., molded onto it.

FIG. 2 shows the contact system when ON. Contact carrier 5 is moved down by the magnet armature (not illustrated) a distance D+Ö in comparison with the ON state, with spring action D of contact spring 7 when ON.

In this position, contact bridge 4 is at a distance A+Ö from stops 8.

FIG. 3 shows the position of the contact system when a short-circuit occurs in the ON state and the associated short-circuit electrodynamic forces act on contact bridge 4. Contact bridge 4 moves upward because of the short-circuit electrodynamic force, opening contacts 2, 3, until it hits stops 8. Because of this, an additional spring action acts on contact spring 7, compressing the spring to length E=C−(D+Ö+A). If contact spring 7 were compressed to block dimension B by the electrodynamic forces before contact bridge 4 is stopped on stops 8, stops 8 would have no effect because contact bridge 4 would pull contact carrier 5 upward. To achieve the desired effect with stops 8, the following condition must be met:

$$C-(D+\ddot{O}+A)<B$$

Only if this condition is met are short-circuit electrodynamic forces prevented from having a destructive effect on contact carrier 5.

Although the present invention is explained with reference to the embodiment shown in the accompanying drawing, it should be recalled that this is not intended to limit the present invention to the embodiment presented, but instead all possible changes, modifications and equivalent arrangements are to be included.

What is claimed is:

1. An electric switching device, comprising:

an electromagnetic system having an ON state and an OFF state;

a contact bridge including movable contacts;

fixed contacts;

a contact carrier having a window, the contact bridge being held in the window by a contact spring, the contact spring having a fully compressed length B, the contact spring being compressed by a length D when the electromagnetic system in the ON state, the contact spring having a length C and the fixed contacts being positioned at a distance Ö from the moveable contacts, when the electromagnetic system is in an OFF state, the contact carrier traveling a distance of D+Ö when the electromagnetic system switches between the ON state and the OFF state;

an arcing chamber including stops, the stops positioned adjacent to a side of the contact bridge facing away from the fixed contacts and being a distance A from the contact bridge when the electromagnetic system is in the OFF state, wherein when the electromagnetic system is in the ON state and an overcurrent condition exists, the contact bridge performs an opening movement as a function of a short-circuit electrodynamic force, the stops limiting the opening movement of the contact bridge so that the contact spring is not compressed to the fully compressed length B.

2. The electric switching device according to claim 1, wherein a condition C−(D+Ö+A)<B is satisfied.

* * * * *